US005895290A

United States Patent [19]

Self, Jr.

[11] Patent Number: 5,895,290

[45] Date of Patent: Apr. 20, 1999

[54] SEALED PANEL MOUNT ELECTRICAL CONNECTOR

[75] Inventor: Daines Milfred Self, Jr., Oak Ridge, N.C.

[73] Assignee: The Whitaker Corporation, Wilmington, Del.

[21] Appl. No.: 08/820,425

[22] Filed: Mar. 12, 1997

[51] Int. Cl.[6] ..... H01R 13/73

[52] U.S. Cl. ..... 439/556; 439/588

[58] Field of Search ..... 439/556, 559, 439/588

[56] References Cited

U.S. PATENT DOCUMENTS 4,909,760 3/1990 O'Keefe, II et al. ..... 439/556

5,586,909 12/1996 Saba ..... 439/559

*Primary Examiner*—Neil Abrams

*Assistant Examiner*—Barry M. L. Standig

*Attorney, Agent, or Firm*—Robert Kapalka

[57] ABSTRACT

A seal for use with an electrical connector having a flange which is dimensioned to confront a mounting panel around a cutout in the mounting panel comprises one-piece seal member including a conductor seal and a flange seal. The conductor seal is configured to sealingly engage conductors extending from the electrical connector, and the flange seal is configured to seal between the mounting panel and the flange when the electrical connector is mounted in the mounting panel.

10 Claims, 2 Drawing Sheets

SEALED PANEL MOUNT ELECTRICAL CONNECTOR

FIELD OF THE INVENTION

The invention relates to a panel mount electrical connector which is sealingly engaged with the panel.

BACKGROUND OF THE INVENTION

A refrigerator often has an electrical connector mounted in a cutout in a panel to provide an interface between electrical devices on opposite sides of the panel. When the panel separates a refrigerated space from a non-refrigerated space, it is necessary to provide a good seal between the electrical connector and the panel in order to prevent exchange of heat and air between the spaces. Presently, a panel mount electrical connector in a refrigerator has a flange which is abutted against the panel. The panel is made from a plastic material, and the panel is often wavy or has other deviations in planarity, thereby causing gaps between the flange and the panel. Further, different panels may vary in thickness, thereby making it difficult to consistently maintain the flange against the panel. During assembly of the refrigerator, an insulative foam is injected over the warm side of the panel. If the panel is wavy or if the flange is not abutted against the panel, the foam will shoot through gaps between the connector and the panel, thereby causing mess and splatter inside the refrigerated space. This problem is exacerbated when wires extending from the connector are pulled and bent during assembly of the refrigerator, thereby cocking the connector in the cutout and causing a larger gap. A further problem exists in that the foam may enter the connector through gaps around the wires and may interfere with electrical reliability of the connector. The invention overcomes these problems by providing a panel mount electrical connector with a one-piece seal member which seals to both the conductors and the flange of the connector.

SUMMARY OF THE INVENTION

It is an object of the invention to provide a sealed panel mount electrical connector.

It is another object of the invention to improve sealing between an electrical connector and a panel in which it is mounted.

According to the invention, a seal for use with an electrical connector having a flange which is dimensioned to confront a mounting panel around a cutout in the mounting panel comprises:

one-piece seal member including a conductor seal and a flange seal, the conductor seal being configured to sealingly engage conductors extending from the electrical connector, and the flange seal being configured to seal between the mounting panel and the flange when the electrical connector is mounted in the mounting panel.

In one embodiment, the conductor seal includes a wall having apertures which are in alignment with conductor-receiving cavities in the electrical connector, and the apertures are dimensioned such that surfaces of the apertures sealingly engage around the conductors. The wall of the seal has projections which are arranged to extend into the conductor-receiving cavities, and the apertures extend through respective ones of the projections. The flange seal includes at least one forwardly projecting rib which is engageable with the mounting panel.

BRIEF DESCRIPTION OF THE DRAWINGS

The invention will now be described by way of example with reference to the accompanying drawings wherein.

DETAILED DESCRIPTION OF THE PREFERRED EMBODIMENT

Figure 1:
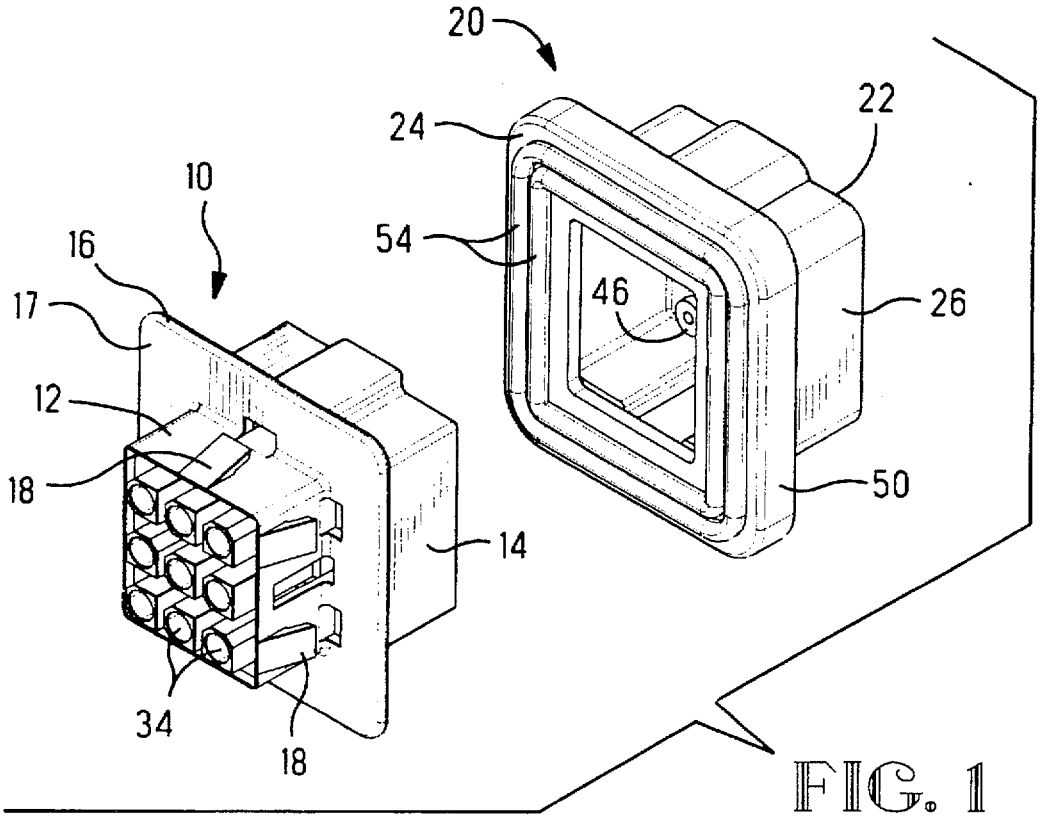
FIG. 1 is a front isometric exploded view of a sealed panel mount electrical connector according to the invention.
Figure 2:
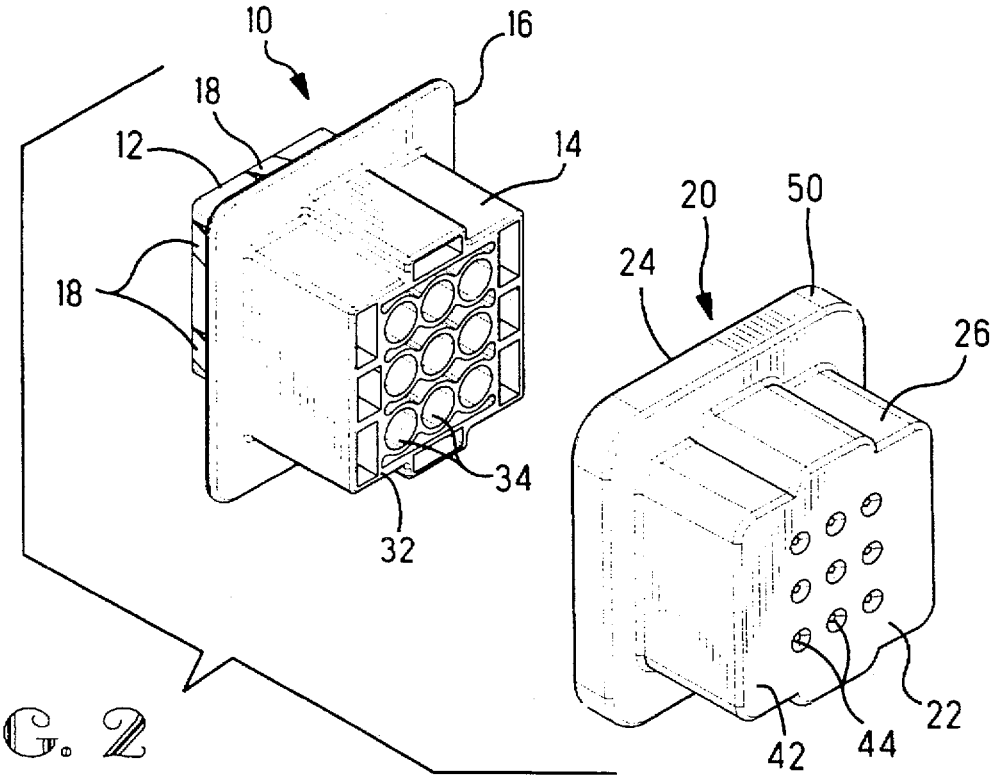
FIG. 2 is a rear isometric exploded view of the connector.

With reference to FIGS. 1 and 2, a sealed panel mount electrical connector according to the invention comprises a dielectric housing 10 and a seal member 20. The housing 10 includes a forward portion 12, a rearward portion 14, and a flange 16 which extends laterally around the housing between the forward and rearward portions. The forward portion 12 is insertable through a cutout in a mounting panel (not shown) which may be, for example, a wall of an appliance or other piece of equipment. The forward portion 12 is configured for mating with a complementary electrical connector. The flange 16 is dimensioned larger than the cutout so that front face 17 of the flange will confront the mounting panel around the cutout. The housing 10 has latches 18 which are arranged in opposition to the flange 16 to capture the mounting panel therebetween and thereby hold the connector in the cutout of the mounting panel.

As best seen in FIG. 2, the rear portion 14 has a rear face 32, and conductor-receiving cavities 34 open into the housing through the rear face 32. The cavities 34 extend through the housing and are open at a front of the forward portion 12. The cavities 34 can hold terminals which are attached to conductors that extend from the housing through the rear face 32.

The seal member 20 includes a conductor seal 22 which engages the conductors exiting from the rear face 32 of the housing, and a flange seal 24 which covers the front face 17 of the flange 16. The seal member 20 is preferably formed as a separate sheath which is pliable so that it can be installed on and removed from the housing 10. However, the seal member 20 may be adhered to the housing 10 by overmolding. The seal member 20 is preferably made from an elastomeric material such as silicon rubber. In the preferred embodiment shown, the seal member 20 has sidewalls 26 which fully enclose the rear portion 14 of the housing 10. However, the seal member 20 may be formed with one or more bands that link the flange seal 24 with the conductor seal 22 but which leave the rear portion 14 of the housing partially uncovered.

Figure 3:
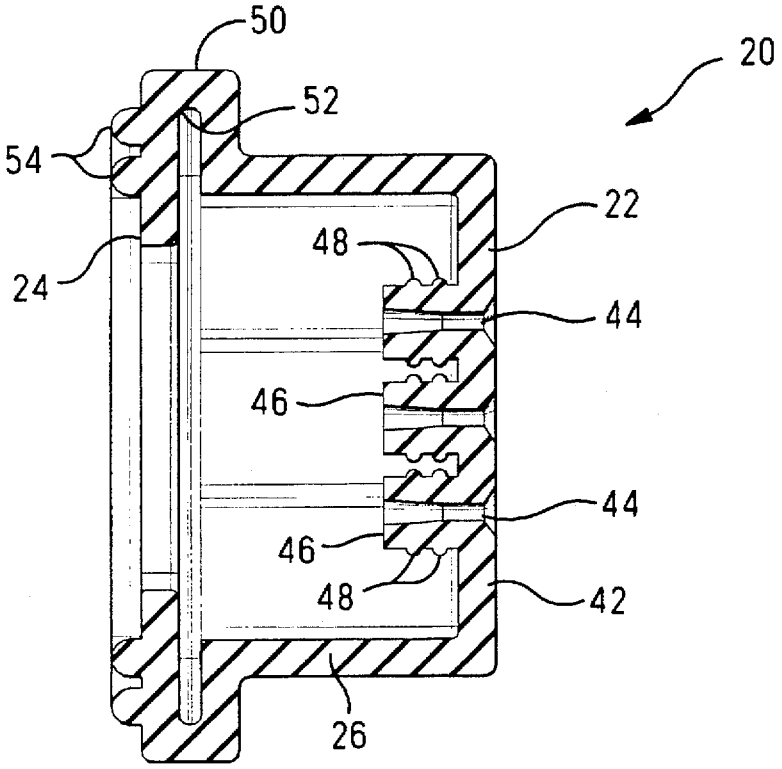
FIG. 3 is a cross-sectional view through a seal member for the connector.
Figure 4:
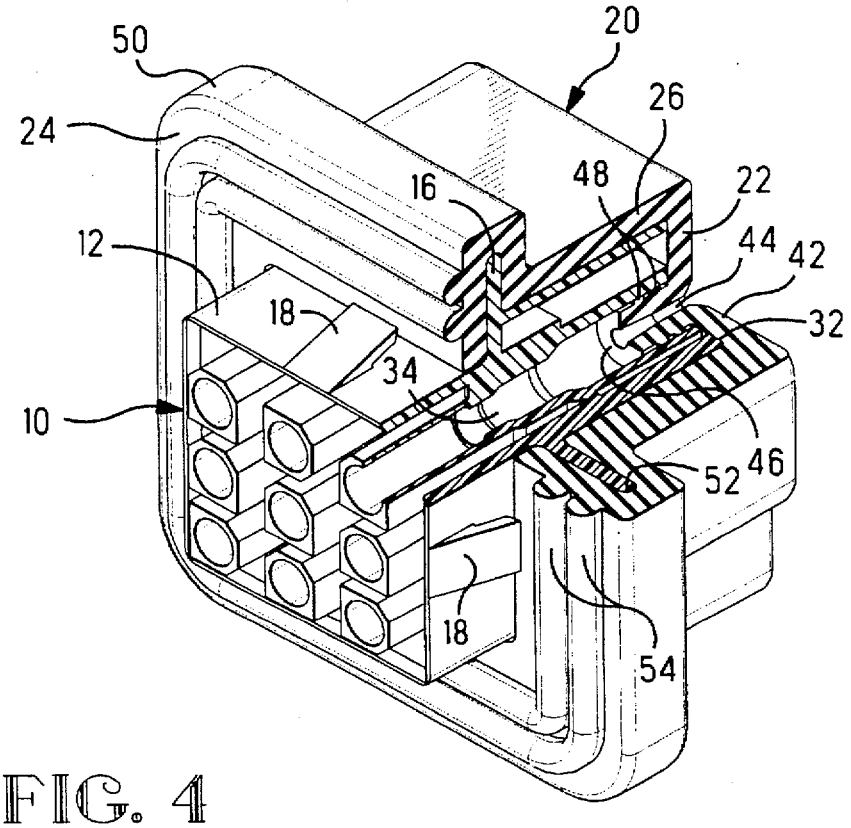
FIG. 4 is an isometric view of the connector in partial cross-section.

The conductor seal 22 is configured to sealingly engage around the conductors which extend through the rear face 32 of the housing. Referring also to FIGS. 3 and 4, the conductor seal includes a wall 42 which is coextensive with the rear face 32 of the housing. The wall 42 has apertures 44 which are aligned with the cavities 34 in the housing, and the apertures are sized to sealingly engage around the conductors. The conductor seal 22 is pliable so that terminals on the ends of the conductors may be inserted through the apertures 44 into their respective cavities 34. The conductor seal may have tubular projections 46 which extend forwardly from the wall 42 and reside within the cavities 34. The apertures 44 are open through the projections 46. Ribs 48 on the projections 46 serve to seal the projections against walls of the cavities 34.

The flange seal 24 is configured to seal between the flange 16 and the mounting panel when the electrical connector is installed in the mounting panel. The flange seal 24 may be formed as a front wall of a flange shroud 50 which covers the flange 16 of the housing. Within the flange shroud 50 is a groove 52 which is dimensioned to receive the flange 16 of the housing. The flange seal 24 may have one or more sealing ribs 54 which add resiliency to the flange seal, thereby increasing the ability of the seal to accommodate waviness or irregularities in the plane of the mounting panel.

The invention provides a one-piece boot-like seal which is fitted on a panel mount electrical connector. The seal prevents contaminants from entering the connector through gaps where conductors pass out of the connector, and the seal also seals the connector to its mounting panel. The seal ensures that the connector will be sealed to the mounting panel regardless of waviness in the panel or variations in thickness of different panels.

I claim:

1. A panel mount electrical connector comprising:

a dielectric housing having a forward mating portion which is receivable in a cutout in a mounting panel, a flange extending laterally from the housing and dimensioned larger than the cutout, latches opposed to the flange for capturing the mounting panel therebetween, and a rear portion having a rear face with conductor-receiving cavities extending inwardly through the rear face; and a one-piece seal member including a conductor seal and a flange seal, the conductor seal being configured to sealingly engage conductors extending from the cavities, and the flange seal being configured to seal between the mounting panel and the flange when the electrical connector is mounted in the mounting panel.

2. The panel mount electrical connector of claim 1, wherein the conductor seal includes a wall which is coextensive with the rear face of the housing, the wall has apertures in alignment with the conductor-receiving cavities, and the apertures are dimensioned such that surfaces of the apertures sealingly engage around the conductors.

3. The panel mount electrical connector of claim 2, wherein the wall has projections which extend into the conductor-receiving cavities, and the apertures extend through respective ones of the projections.

4. The panel mount electrical connector of claim 1, wherein the flange seal includes a forwardly projecting rib.

5. The panel mount electrical connector of claim 1, wherein the flange seal includes an inner groove which is dimensioned to receive the flange of the housing.

6. The panel mount electrical connector of claim 1, wherein the seal encloses the rear portion of the housing between the flange and the rear face.

7. A seal for use with an electrical connector having a flange which is dimensioned to confront a mounting panel around a cutout in the mounting panel, the seal comprising:

one-piece seal member including a conductor seal and a flange seal, the conductor seal being configured to sealingly engage conductors extending from the electrical connector, and the flange seal being configured to seal between the mounting panel and the flange when the electrical connector is mounted in the mounting panel.

8. The seal of claim 7, wherein the conductor seal includes a wall having apertures which are in alignment with conductor-receiving cavities in the electrical connector, and the apertures are dimensioned such that surfaces of the apertures sealingly engage around the conductors.

9. The seal of claim 8, wherein the wall has projections which are arranged to extend into the conductor-receiving cavities, and the apertures extend through respective ones of the projections.

10. The seal of claim 7, wherein the flange seal includes a forwardly projecting rib.

* * * * *